United States Patent [19]

Instance

[11] Patent Number: 4,699,833

[45] Date of Patent: Oct. 13, 1987

[54] LABEL

[76] Inventor: David J. Instance, Guinea Hall, Sellindge, Kent, United Kingdom

[21] Appl. No.: 895,950

[22] Filed: Aug. 13, 1986

[30] Foreign Application Priority Data

Aug. 14, 1985 [GB] United Kingdom ..... 8520416

[51] Int. Cl.[4] ..... B65D 27/00

[52] U.S. Cl. ..... 428/42; 428/43; 428/124; 428/130; 40/2 R; 229/68 R; 281/14; 281/18; 283/81; 283/103; 283/105; 283/106

[58] Field of Search ..... 428/42, 43, 124, 130, 428/906; 281/14, 18; 283/81, 103, 105, 106, 107; 40/2 R, 306, 310; 206/390, 484; 229/68 R

[56] References Cited

FOREIGN PATENT DOCUMENTS 1475304 6/1977 United Kingdom .
2115744 9/1983 United Kingdom ..... 229/68 R
2127378 4/1984 United Kingdom .

*Primary Examiner*—Alexander S. Thomas
*Attorney, Agent, or Firm*—Birch, Stewart, Kolasch & Birch

[57] ABSTRACT

A label for attachment to a product, the label including an integral sheet and envelope having a sheet portion such as a sheet of printed instructions, and an envelope portion for removably carrying the sheet portion, the sheet portion and envelope portion being both formed from a common single folded sheet. The sheet is divided into at least first and second parallel rows of three rectilinear panels each. The panels of the first row are separated from the corresponding panels of the second row by a fold line which extends transversely relative to side edges of the sheet, and a line of perforations which extends between and transversely relative to the side edges of the sheet across the second row of panels so as to separate the envelope portion and the sheet portion. The second row of panels is folded about the fold line so as to lie adjacent corresponding panels of the first row, the two outer panels of the first and second rows being folded behind the remaining center panels such that the first row of panels defines the envelope portion which contains the sheet portion defined by the second row of panels. A front face of the center panel of the first row forming an exposed front of the envelope portion, with the folded over outer panels of the first row and the the central portion forming the rear of the envelope portion and being adhered to a support web, the envelope portion remaining open along the one end edge which remains uncovered so that the sheet portion is removable from the envelope portion through the one end edge, while the envelope portion remains folded, by tearing the sheet portion along the line of perforations.

6 Claims, 4 Drawing Figures

LABEL

BACKGROUND TO THE INVENTION

This invention relates to a label and in particular to a label in the form of a sheet (e.g. a sheet of printed instrutions) and an envelope therefor.

It is frequently desirable to be able to attach a sheet of printed instructions to a product, and to avoid soiling of the sheet during handling of the product or loss of the sheet during such handling, it is desirable that the sheet should be enclosed in an envelope and held from falling out. If the means for holding the sheet can be made such as to require a non-repeatable action to remove the sheet from the envelope, they will afford an indication of unauthorised tampering.

In my British Pat. No. 1475304 there is described and claimed a sheet (e.g. of printed instructions) and an envelope therefor both formed from a single folded sheet, e.g. of paper, the single sheet being divided into at least two parallel rows of three rectilinear panels each, the two outer panels of a first row being separated from the corresponding two outer panels of the next row by cuts and the middle panels of the said first and next rows being joined to one another through a line of perforations aligned with the cuts, the single sheet being so folded that the panels of the first row form the envelope and the sheet, e.g. of instructions, is composed of the panels of the next row and of any further rows which are folded to lie adjacent one face of the middle panel of the first row, whereby the sheet, e.g., of instructions, is enclosed in the envelope but can be removed and detached therefrom by tearing along the line of perforations.

I found that the sheet and envelope described in my British Pat. No. 1475304 can suffer from the disadvantage, particularly if the resultant envelope is over a certain size, that when the sheet of instructions is first pulled out of the envelope and the said line of perforations has to be torn apart, quite often before the line of perforations will tear, the sheet of instructions pulls upwardly that part of the sheet which forms the lower part of the envelope. This causes the envelope to become buckled and misaligned so that re-introduction of the sheet of instructions into the envelope can be difficult, if not impossible.

I susbequently developed a modified sheet and envelope arrangement which overcame that disadvantage. British Pat. Specification No. 2115744 accordingly provided a sheet and an envelope therefor, both formed from a single folded sheet, wherein the single sheet is divided into at least two parallel rows of three rectilinear panels each, the panels of the first row being separated from the corresponding panels of the next row by a line of perforations and each of the two outer panels of the first row of panels having a portion cut away inwardly from the respective outer edge of the sheet adjacent the line of perforations so that the line of perforations stops short of the outer edges of the sheet, the single sheet being so folded that the panels of the first row form the envelope, and the sheet of instructions is composed of the panels of the next row and of any further rows which are folded to lie adjacent one face of the corresponding panels of the first row, whereby the sheet is enclosed in the envelope but can be removed and detached therefrom by tearing along the line of perforations.

However the label disclosed in my British Pat. Specification No. 2115744 suffers from the disadvantage that the sheet must be die-cut in order to form the cut away portions. The die cutting step is a separate process step which tends to reduce the rate of production of the labels and accordingly increases the unit cost of the labels.

SUMMARY OF THE INVENTION

The present invention relates to a label in which the sheet does not require to be die-cut prior to folding.

Accordingly, the present invention provides a label for attachment to a product, the label including an integral sheet and envelope comprising a sheet portion such as a sheet of printed instructions, and an envelope portion for removably carrying the sheet portion. The sheet portion and envelope portion are both formed from a common single folded sheet. The sheet comprising opposing side edges interconnected by opposing end edges with the sheet being divided into at least first and second parallel rows of three rectilinear panels each. The panels of the first row forming one of the end edges is separated from the corresponding panels of the second row by a fold line which extends transversely relative to the side edges of said sheet, a line of perforations extends between and transversely relative to the side edges of the sheet across the second row of panels so as to separate the envelope portion and the sheet portion. The second row of panels is folded about the fold line so as to lie adjacent corresponding panels of the first row, the two outer panels of the first and second rows being folded behind the remaining centre panels such that the first row of panels defines the envelope portion which contains the sheet portion defined by the second row of panels. The transverse width of the outer panels of the first and second rows being such that the opposing end panels of the first and second rows do not meet each other when the two outer panels of the first and second rows are folded behind the centre panels as aforesaid thereby to expose a central portion of the centre panel of the second row which is between the fold line and the line of perforations. A front face of the centre panel of the first row forms an exposed front of the envelope portion, with the folded over outer panels of the first row and the central portion forming the rear of said envelope portion and being adhered to a support web. The envelope portion remaining open along the one end edge which remains uncovered so that said sheet portion is removable from said envelope portion through said one end edge, while said envelope portion remains folded, by tearing said sheet portion along said line of perforations.

Preferably, the opposing outer panels of the first and second rows have substantially equal width.

In the preferred arrangement, the common single folded sheet is rectangular in its unfolded condition.

In one preferred embodiment, the opposing outer panels of the first and second rows each have a transverse width which is about one third of the transverse width of the centre panels of the first and second rows.

The present invention also provides a reel of release backing material comprising thereon a succession of the labels of the present invention.

DESCRIPTION OF THE PREFERRED EMBODIMENTS

Figure 1:
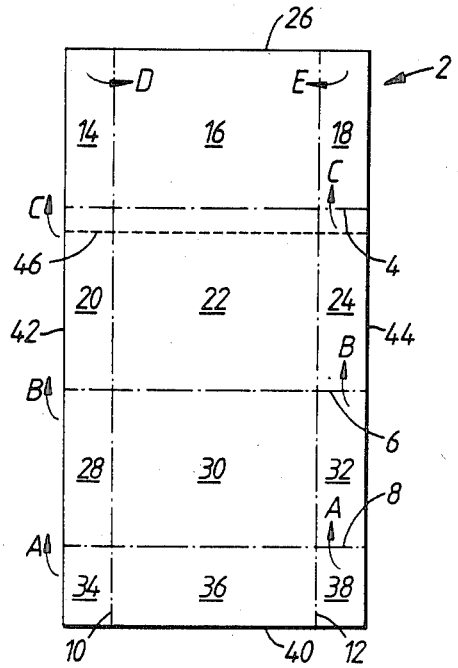
FIG. 1 is a plan view of a sheet prepared for folding to form a label in accordance with the invention.

Referring to FIG. 1, a rectangular sheet 2 of e.g. paper is divided into four rows of three panels each. The sheet 2 is rectangular in its unfolded condition. The sheet 2 is a longitudinal strip which has three transverse fold lines 4, 6, 8 and two longitudinal fold lines 10, 12, each fold line extending between the appropriate longitudinal or transverse edges of the sheet 2.

The transverse fold line 4 between the first row of panels 14, 16, 18 and the second row of panels 20, 22, 24 is spaced a particular distance from the first end edge 26 of the sheet 2, the distance being approximately one quarter of the length of the sheet 2. The second transverse fold line 6, which is between the second row of panels 20, 22, 24 and the third row of panels 28, 30, 32 is spaced from the first transverse fold line 4 by a distance which is slightly greater than that which separates the first transverse fold line 4 and the first end edge 26. The third transverse fold line 8, which separates the third row of panels 28, 30, 32 and the fourth row of panels 34, 36, 38, is spaced from the second transverse fold line 6 substantially the same distance as that between the first transverse fold line 4 and the first end edge 26. The second end edge 40 of the sheet 2 is spaced from the third transverse fold line 8 by a distance which is less than that between the second and third transverse fold lines 6, 8.

The two longitudinal fold lines 10, 12 are each spaced inwardly from a respective one of the side edges 42, 44 of the sheet a distance which is substantially less than one quarter of the width of the sheet 2. In the illustrated arrangement, the outer panels of each of the four rows of panels have substantially the same transverse width. In the preferred arrangement the outer panels are each about one third as wide as the central panels of the rows.

A transverse line of perforations 46 extends between the two side edges 42, 44 of the sheet across the second row of panels 20, 22, 24. The line of perforations 46 is spaced from the first transverse line 4 by a distance which is substantially the difference in the length of the second and first rows of panels 20, 22, 24; 14, 16, 18. The line of perforations 46 divides the sheet 2 into an envelope portion, which is defined by the first row of panels 14, 16, 18 and that minor part of the second row of panels 20, 22, 24 which is between the first transverse fold line 4 and the line of perforations 46, and a tear-off portion, which is defined by the remaining major part of the second row of panels 20, 22, 24 and by the third and fourth rows of panels 28, 30, 32; 34, 36, 38.

In order to make the label of the invention, the sheet 2 is first folded about transverse fold line 8, as shown by the arrows A, so as to dispose the fourth row of panels 34, 36, 38 against the third row of panels 28, 30, 32. The third and fourth rows of panels 28, 30, 32; 34, 36, 38 are then folded about the second transverse fold line 6, as shown by the arrows B, so as to dispose those rows of panels against the second row of panels 20, 22, 24. The second, third and fourth rows of panels are then folded about the first transverse fold line 4 as shown by the arrows C, so as to be disposed over the first row of panels 14, 16, 18. It may be seen that due to the spacing of the second and third transverse fold lines 6, 8 and the line of perforations 46, the folded edge which is formed by the third transverse fold line 8 is disposed substantially and spaced from the first transverse fold line 4 and this tends to prevent buckling of the sheet 2 when it is folded as described above.

Finally, the end panels 14, 20, 28, 34; 18, 24, 32, 38 of the four rows of panels are folded about a respective one of the longitudinal fold lines 10, 12, as shown by arrows D and F, so as to dispose the end panels of each row over the central panels of each row.

Figure 2:
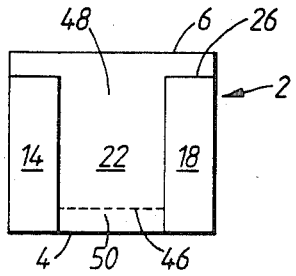
FIG. 2 is a plan view of the sheet of FIG. 1 when folded.

FIG. 2 shows the resultant folded sheet 2.

It may be seen that since the width of the end panels is less than one quarter of total width of the sheet 2, then the two rows of end panels do not meet after being folded about the longitudinal fold lines 10, 12. Instead, a middle part 48 of the central panel 22 of the second row of panels is exposed between the folded end panels. The exposed middle part 48 includes a portion of the line of perforations 46 and also a central portion 50 of the minor part of the central panel 22 of the second row of panels which is between the first transverse fold line 4 and the line of perforations 46 and which constitutes a part of the envelope portion.

Figure 3:
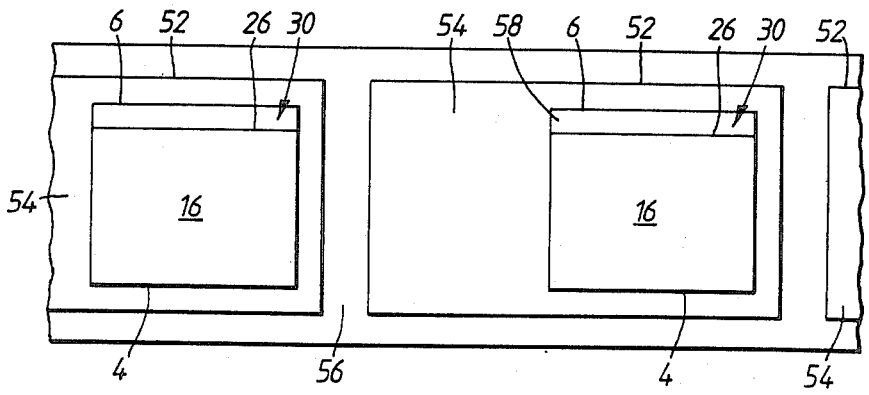
FIG. 3 is a plan view showing a plurality of labels in accordance with the invention when carried on release backing material, each label incorporating one of the folded sheets of FIG. 2.

The face of the folded sheet which is shown in FIG. 2 is the rear face of the sheet when incorporated in the resultant label of the invention. Referring to FIG. 3, there is shown a plurality of labels 52 in accordance with the invention. Each label 52 consists of a label base portion 54, e.g. of paper, which has its rear surface coated with a pressure-sensitive adhesive which renders the rear surface self-adhesive. The self-adhesive labels 52 are carried on a release backing material 56, which for convenience may be wound up into a reel. In use, the labels 52 are peeled away from the release backing material 56 and then adhered by their self-adhesive surface to a container to be labelled.

Each folded sheet 2 is adhered by its rear face to a respective label base portion 54. A suitable adhesive, such as a water-borne adhesive, for example pVA (polyvinyl alcohol) adhesive, is deposited onto the front face of the label base portion 54. The adhesive is deposited in the form of a U corresponding to the U-shape which is defined by the two exposed folded over end panels 14, 18 of the first row of panels 14, 16, 18 and the exposed central portion 50 of the central panel 22 of the second row of panels 20, 22, 24. Thus those exposed parts 14, 18, 50 of the rear face of the folded sheet 2 which are part of the envelope portion are adhered to the label base portion 54. The remainder of the rear face of the folded sheet 2 forms part of the tear-off portion and is not adhered to the label base portion.

Since the second row of panels 20, 22, 24 is longer than the first row of panels 14, 16, 18, the second and third row of panels 20, 22, 24; 28, 30, 32 extend above the first end edge 26 of the sheet 2 and form an exposed part 58 of the tear-off portion. The exposed part 58 of the tear-off portion can be gripped by the fingers of a user and then pulled upwardly so as to tear the sheet 2 along the line of perforations 46 and separate the tear-off portion from the envelope portion. The tear-off portion can be pulled out of the envelope portion and then unfolded so that it can be read by a user. After use, the tear-off portion can be re-folded and then slipped back into the envelope portion for safe-keeping until it is required again.

The particular way in which the sheet 2 is folded and the particular position of the line of perforations 46 ensures that the envelope portion and the tear-off portion can be clearly separated along the line of perforations 46 without any undesirable buckling or tearing of the sheet occurring. The central portion 50 of the central panel 22 of the second row of panels 20, 33, 24 is adhered directly to the label base portion 54. This adhesion ensures that when the tear-off portion is pulled upwardly by a user, the central portion 50 of the central panel 22 remains securely attached to the label base portion 54 and thereby prevents the central panel 16 of the first row of panels 14, 16, 18 from being either torn or buckled inwardly and upwardly due to the upward tearing force which is exerted by the user when tearing off the tear-off portion along the line of perforations 46.

The labels of the present invention may be made by the method which is disclosed in my British Pat. Specification No. 2127378. In accordance with that method, the pre-folded sheets 2 are adhered in succession to a succession of self-adhesive label base portions 54 which are carried on a length of release backing material.

The labels of the present invention have an advantage over the label which is disclosed in my British Pat. Specification No. 2115744. In that specification, it was necessary for the sheets to be die-cut prior to folding in order to form cut-away portions in the sheet. In the label of the present invention, the line of perforations 46 extends between the two side edges 42, 44 of the sheet 2 and since the end panels are folded so that they do not meet in the region of the middle of the central panels, there is no need for the cut-away portions which are required in the labels of British Pat. Specification No. 2115744. The sheet 2 is folded in a particular manner so as to allow the central portion 50 of the central panel 22 to be revealed, this being achieved without the need for cut-away portions. Since the cut-away portions of the prior art are not required this permits the labels of the invention to be manufactured with a lower number of process steps and accordingly at lower unit cost. The sheet 2, which is appropriately printed, can, after the printing step, be passed directly through a sheet-folding apparatus in which the sheet 2 automatically has the line of perforations 46 formed therein and is automatically folded as required.

This obviates the need for a separate die-cutting step as is required by the prior art.

It will be apparent to those skilled in the art that the dimensions of the various panels of the sheet can be varied as described without departing from the present invention. Also, the sheet may be provided with more or fewer rows of panels of varying length.

The labels of the present invention may be made as self-adhesive labels on a reel of release backing material by the methods which are disclosed in my British Pat. No. 2127378 entitled "Method of Producing Labels".

Figure 4:
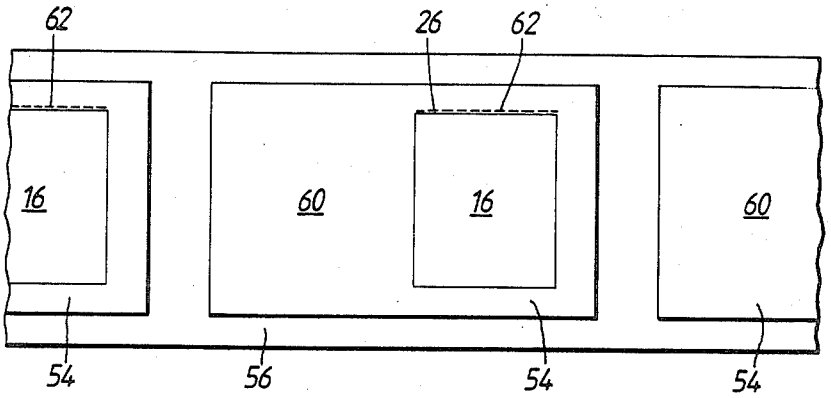
FIG. 4 is a plan view of a plurality of labels in accordance with a second embodiment of the invention when carried on a release backing material.

Referring to FIG. 4, in an alternative label in accordance with the present invention, the length of the first row of panels 14, 16, 18, (i.e. the distance between the first transverse fold line 4 and the end edge 26) is made slightly greater than the length of any of the other rows of panels such that when the sheet 2 is folded as aforesaid, the front of the folded label consists solely of the front face of the central panel 16 of the first row of panels, and that central panel 16 covers all of the remaining panels of the sheet 2.

This arrangement results in the tear off portion being completely enclosed within the envelope portion. The assembly of the folded label 2 adhered to the support web 54 is covered with an over laminate of a self-adhesive plastics sheet 60, typically of polyester, which protects the assembly from damage or soiling prior to use. A line of perforations 62 which has been formed by die-cutting through the polyester sheet 60 extends along the end edge 26 of the central panel 16 of the first row of panels. A user can access the tear off portion by tearing along the line of perforations 62 and then opening the unfolded edge of the envelope portion.

The label which is shown in FIG. 4 may be made self-adhesive and carried on a reel of release backing material. The folded sheets are adhered in succession to a succession of self-adhesive label base portions which are carried on a length of release backing material. The polyester sheet is then laminated over the assembly of the folded sheets and the label base portions. Then the polyester sheet is die-cut so as to cut the lines of perforations and so as to cut the polyester sheet into a succession of portions each of which covers a respective label of the invention. The waste web remnant of the polyester sheet, and, if appropriate, the support web, is removed so as to produce a succession of polyester sheet-covered labels a length of release backing material, as is shown in FIG. 4.

What I claim is:

1. A label for attachment to a product, the label including an integral sheet and envelope comprising a sheet portion such as a sheet of printed instructions, and an envelope portion for removably carrying the sheet portion, the sheet portion and envelope portion being both formed from a common single folded sheet, the sheet comprising opposing side edges interconnected by opposing end edges, the sheet being divided into at least first and second parallel rows of three rectilinear panels each, the panels of the first row forming one of the end edges and being separated from the corresponding panels of the second row by a fold line which extends transversely relative to the side edges of said sheet, and a line of perforations which extends between and transversely relative to the side edges of the sheet across the second row of panels so as to separate the envelope portion and the sheet portion, the second row of panels being folded about the fold line so as to lie adjacent corresponding panels of the first row, the two outer panels of the first and second rows being folded behind the remaining centre panels such that the first row of panels defines the envelope portion which contains the sheet portion defined by the second row of panels, the transverse width of the said outer panels of the first and second rows being such that the opposing end panels of the first and second rows do not meet each other when the two outer panels of the first and second rows are folded behind the centre panels as aforesaid thereby to expose a central portion of the centre panel of the second row which is between the fold line and the line of perforations, a front face of the centre panel of the first row forming an exposed front of the envelope portion, with the folded over outer panels of the first row and the said central portion forming the rear of said envelope portion and being adhered to a support web, the envelope portion remaining open along the said one end edge which remains uncovered so that said sheet portion is removable from said envelope portion through said one end edge, while said envelope portion remains folded, by tearing said sheet portion along said line of perforations.

2. A label according to claim 1, wherein the opposing outer panels of the first and second rows have substantially equal transverse widths.

3. A label according to claim 1, wherein the common single-folded sheet is rectangular in its unfolded condition.

4. A label according to claim 1, wherein the opposing outer panels of the first and second rows each have a transverse width which is about one third of the transverse width of the centre panels of the first and second rows.

5. A label according to claim 1, wherein the sheet is folded such that the sheet portion is completely enclosed within the envelope portion and further comprising a plastics sheet which covers the folded sheet and the support web and has a line of perforations therethrough which extends along the said one end edge whereby tearing of the line of perforations permits access to the sheet portion.

6. A reel of release backing material carrying thereon a succession of labels as claimed in claim 1.

* * * * *